US010458715B2

(12) United States Patent
Diffey

(10) Patent No.: US 10,458,715 B2
(45) Date of Patent: Oct. 29, 2019

(54) HEAT EXCHANGER

(71) Applicant: HS Martson Aerospace Limited, Staffordshire (GB)

(72) Inventor: Jacob Diffey, Bristol (GB)

(73) Assignee: HS MARSTON AEROSPACE LIMITED, Wolverhampton (GB)

( * ) Notice: Subject to any disclaimer, the term of this patent is extended or adjusted under 35 U.S.C. 154(b) by 0 days.

(21) Appl. No.: 15/907,316

(22) Filed: Feb. 28, 2018

(65) Prior Publication Data

US 2018/0320981 A1 Nov. 8, 2018

(30) Foreign Application Priority Data

May 2, 2017 (EP) ..... 17168991

(51) Int. Cl.

| | |
|---|---|
| ***F28F 3/00*** | (2006.01) |
| ***F28D 9/00*** | (2006.01) |
| ***F01M 5/00*** | (2006.01) |
| ***F28F 3/02*** | (2006.01) |
| ***F28F 17/00*** | (2006.01) |
| ***F28F 19/00*** | (2006.01) |

(Continued)

(52) U.S. Cl.

CPC ..... *F28D 9/0093* (2013.01); *F01M 5/002* (2013.01); *F01M 5/005* (2013.01); *F01M 5/021* (2013.01); *F28F 3/025* (2013.01); *F28F 3/027* (2013.01); *F28F 3/08* (2013.01); *F28F 17/00* (2013.01); *F28F 19/006* (2013.01); *F28D 2021/0089* (2013.01)

(58) Field of Classification Search

CPC ..... F28D 9/0093; F28D 2021/0089; F01M 5/021; F01M 5/005; F01M 5/002; F28F 3/08; F28F 3/025; F28F 19/006; F28F 17/00; F28F 3/027

See application file for complete search history.

(56) References Cited

U.S. PATENT DOCUMENTS 2,419,264 A * 4/1947 Holmes ..... F16N 39/02 165/132
2,778,606 A * 1/1957 Lloyd ..... F28F 1/02 165/149

(Continued)

FOREIGN PATENT DOCUMENTS

CA 2298116 A1 8/2000
EP 0538849 A1 4/1993

(Continued)

OTHER PUBLICATIONS

Extended European Search Report for International Application No. 17168991.2 dated Dec. 6, 2017, 6 pages.

*Primary Examiner* — Claire E Rojohn, III
(74) *Attorney, Agent, or Firm* — Cantor Colburn LLP

(57) ABSTRACT

A heat exchanger and a method for manufacturing a heat exchanger, the heat exchanger comprising: a first plurality of layers, each of the first plurality of layers including: a corrugated sheet comprising a series of regular corrugations across its width for flow of liquid therethrough, the series of corrugations having a predetermined period; and a de-congealing channel for flow of liquid across the width of the corrugated sheet in parallel with the corrugations, the de-congealing channel formed at least in part by two adjacent corrugations, that are separated by greater than the predetermined period.

11 Claims, 4 Drawing Sheets

(51) Int. Cl.

| | |
|---|---|
| ***F28F 3/08*** | (2006.01) |
| ***F01M 5/02*** | (2006.01) |
| *F28D 21/00* | (2006.01) |

(56) References Cited

U.S. PATENT DOCUMENTS

| | | | | |
|---|---|---|---|---|
| 9,448,010 | B2 * | 9/2016 | Van Lieu | F28F 3/025 |
| 2001/0054501 | A1 | 12/2001 | Wehrmann et al. | |
| 2007/0267187 | A1 * | 11/2007 | Wolk | F28F 1/128 165/181 |
| 2012/0125594 | A1 * | 5/2012 | Elder | F28D 1/053 165/300 |
| 2014/0044525 | A1 * | 2/2014 | Storage | F28F 3/12 415/144 |
| 2014/0202158 | A1 * | 7/2014 | Storage | F02C 7/12 60/722 |
| 2015/0096727 | A1 | 4/2015 | Drankow et al. | |
| 2015/0135726 | A1 * | 5/2015 | Hundley, Jr. | F02C 7/12 60/796 |
| 2016/0033209 | A1 * | 2/2016 | Campbell | B23P 15/26 165/170 |
| 2016/0072165 | A1 * | 3/2016 | Abels | B23K 1/0012 429/120 |
| 2016/0090863 | A1 * | 3/2016 | Diaz | F01D 25/18 60/39.1 |
| 2016/0187067 | A1 * | 6/2016 | Kobayashi | F28D 9/0093 165/166 |
| 2016/0216053 | A1 * | 7/2016 | Storage | F16K 11/02 |
| 2016/0320141 | A1 * | 11/2016 | Barfknecht | F28D 9/0093 |
| 2017/0254598 | A1 * | 9/2017 | Van Bockryck | F28F 3/10 |

FOREIGN PATENT DOCUMENTS

| | | | | |
|---|---|---|---|---|
| EP | 2696056 | A2 | 2/2014 | |
| WO | WO-2016029115 | A1 * | 2/2016 | F28F 3/027 |

* cited by examiner

HEAT EXCHANGER

FOREIGN PRIORITY

This application claims priority to European Patent Application No. 17168991.2 filed May 2, 2017, the entire contents of which is incorporated herein by reference.

TECHNICAL FIELD

The present disclosure relates to a heat exchanger, particularly a heat exchanger comprising a plurality of layers.

BACKGROUND

During cold start conditions, a liquid such as oil within a heat exchanger can be subject to very low temperatures. These low temperatures can cause the oil to have a very high viscosity, which in turn can cause the oil to congeal. The congealed oil causes high pressure losses in the system which can lead to the heat exchanger system seizing up. To mitigate these conditions, warm inlet oil can be passed through the heat exchanger to warm the cold oil inside and heat it up, thereby reducing its viscosity and allowing it to flow more freely.

To this end, a de-congealing channel may be provided to supply warm oil to the heat exchanger matrix. Such an arrangement places limitations on the geometry and construction of the heat exchanger.

SUMMARY

According to a first aspect of the invention there is provided a heat exchanger comprising: a first plurality of layers, each of the first plurality of layers including a corrugated sheet comprising a series of regular corrugations across its width for flow of liquid therethrough, the series of corrugations having a predetermined period; and a de-congealing channel for flow of liquid across the width of the corrugated sheet in parallel with the corrugations, the de-congealing channel formed at least in part by two adjacent corrugations that are separated by greater than the predetermined period.

The corrugated sheet comprises corrugations (such as parallel ridges, grooves or folds) which may hence be considered to have the shape of a waveform, comprising peaks and troughs with a predetermined spacing therebetween. Thus, the corrugations have a predetermined period defined as the distance between the same points of neighbouring, contacting corrugations, i.e. the distance between neighbouring peaks of adjacent corrugations. Hence the series of corrugations are regularly spaced (but for the de-congealing channel).

During use, a liquid such as oil flows along the length of the corrugations, e.g. along the channels formed by the peaks and troughs, across the width of the corrugated sheet. The liquid thus contacts a greater surface area than if the sheet were flat, thereby allowing improved heat exchange to/from the liquid.

The de-congealing channel is defined by the space between two corrugations which are separated by a distance greater than the predetermined period. Thus, the same points of the corrugations immediately to either side of the de-congealing channel are separated by a distance greater than the predetermined period, e.g. the peaks of the two corrugations are more than the predetermined period apart.

Hence, liquid can flow both along the corrugations, and along the de-congealing channel between two corrugations. The larger flow path of the de-congealing channel can allow for less resistance to flow than the smaller flow paths of the corrugations. When warm liquid flows along the de-congealing channel, it can transfer heat to neighbouring corrugations, which in turn transfer heat to their neighbours and so on, thereby spreading heat through the entire layer and warming all the liquid in the layer.

The length of the corrugations is defined across the width of the corrugated sheet. The length of the corrugated sheet is defined in the direction of the width of the corrugations. Hence, the corrugations have the shape of a regular, periodic waveform along the length of the corrugated sheet, and during use liquid flows perpendicularly to the length of the corrugated sheet and the direction of the predetermined periodicity.

During use, liquid flow in the heat exchanger may be through only the corrugations and the de-congealing channel. The de-congealing channel may be formed entirely by a space between the corrugations in a layer. The corrugations may thus extend across the entire width of the layer and/or may run the entire length of the layer, except for the space between corrugations defining the de-congealing channel.

Each corrugation may have an oscillating geometry along the length of the corrugation across the width of the corrugated sheet. That is, the corrugation may itself have variation in its geometry along its length, in a direction perpendicular to the length of the corrugated sheet. The variation may be periodic, and may be in the direction of the plane of the corrugated sheet. Each corrugation may have the shape of a waveform, so that during use liquid flowing along the length of each corrugation will take an oscillatory path across the width of the corrugated sheet. The oscillation along the length of the corrugation may have a constant period and amplitude. The term 'oscillation' in this instance refers to the change of the corrugation along its length and does not mean that the corrugation itself changes shape with time.

Each corrugation may comprise an opening for fluid communication between the corrugations. Thus, liquid may flow between corrugations, and heat transfer between corrugations may thereby be facilitated. The corrugation may comprise multiple openings in its side in a repeated pattern. The openings may be formed such that liquid may flow in a straight line across the width of the sheet, in and out of the corrugation. The opening or openings may extend across the depth of the layer (i.e. from top to bottom in the orientation shown in the figures). The opening or openings may be defined in the same direction as the length of the corrugated sheet, and may only be open in that direction. The openings may be orthogonal to the liquid flow direction.

The heat exchanger may comprise a plurality of fins for intercepting and/or directing a flow of liquid through the corrugation. The fins may be in addition to the corrugation, and/or may be formed from part of the corrugation e.g. formed by walls of the corrugation, separated by the openings described above. Hence, the corrugations may be discontinuous along their length across the sheet, and may thereby fluidly communicate with each other. The fins may serve to interrupt and/or intercept flow of liquid across the sheet, and may improve heat transfer to/from the liquid.

The de-congealing channels may form throughways from one side to the other side of each layer of the first plurality of layers which is larger than throughways formed by the corrugations. The cross-section of the de-congealing channel may be larger than that of each corrugation. The de-congealing channel may not have obstructions such as fins disposed therein to interrupt the flow of liquid. Therefore, the de-congealing channel provides a flow path with improved flow for cold/congealed liquid with higher viscosity. Congealed liquid such as oil may thus flow more easily during use though the de-congealing channel than through a corrugation. The flow of liquid through the de-congealing channel may therefore spread heat across the width of the layer for heating and hence de-congealing the rest of the liquid in the corrugations. The flow of liquid through the de-congealing channel may also fluidly communicate with liquid in neighbouring corrugations, thereby spreading heat thereto.

The heat exchanger may further comprise a second plurality of layers for flow of a fluid therethrough, and may comprise alternating layers from the first and second pluralities of layers. Two layers of the first plurality of layers may thus have a layer of the second plurality of layers therebetween, and two layers of the second plurality may have a layer of the first plurality therebetween (except for any outermost layers). Layers of the first plurality of layers may therefore be in a heat exchanging relationship with layers of the second plurality of layers. In use, the layers of the second plurality of layers may contain a flow of a fluid (e.g. air) to exchange heat with liquid in the first plurality of layers. The flow of fluid in the second plurality of layers may be substantially perpendicular to the flow of liquid in the layers of the first plurality of layers.

The layers of the second plurality of layers may prevent flow of liquid between the layers of the first plurality of layers. The heat exchanger may comprise a separator between layers of the heat exchanger for preventing fluid flow between those layers. Liquid within one of the layers of the first plurality may not be able to flow directly to another layer of the first plurality without first leaving the one layer. Each layer of the first plurality of layers that uses liquid as a working fluid may comprise a respective de-congealing channel i.e. every layer which in use contains liquid may comprise a de-congealing channel. There may be a plurality of de-congealing channels in each layer of the first plurality of layers, which may be separated by corrugations therebetween.

The de-congealing channel of each layer of the first plurality of layers may be aligned with the de-congealing channel of one of the nearest other layers of the first plurality of layers. The de-congealing channels in each layer may be disposed one above the other in the stacking direction of the layers. The de-congealing channels may thereby concentrate warm liquid in a predetermined region of the heat-exchanger during a cold start, and may hence have a combined effect in improving efficiency in the heat exchanger.

Alternatively, the de-congealing channel of each layer of the first plurality of layers may not be aligned with the de-congealing channel of one of the nearest other layers of the first plurality of layers, or may be aligned so as not to be one above the other in the stacking direction of the layers. Hence, the de-congealing channels may be arranged throughout the heat-exchanger in the desired manner. They may be evenly distributed throughout the heat exchanger so as to spread heat evenly to all regions of the heat exchanger as quickly as possible during use. They may be arranged across a diagonal of the heat exchanger. The majority of the de-congealing channels may be aligned, and the rest not aligned. The arrangement of the de-congealing channels is therefore flexible and can be tailored to its purpose for each application.

Each layer of the first plurality of layers may comprise a plurality of de-congealing channels. The plurality of de-congealing channels in each layer may be aligned with the plurality of de-congealing layers in others of the first plurality of layers. Alternatively, the plurality of de-congealing channels in each layer may not be aligned with the plurality of de-congealing channels in others of the first plurality of layers. Moreover, only some of the de-congealing channels of a layer of the first plurality of layers may be aligned with some of the de-congealing channels of others of the first plurality of layers.

The series of corrugations may be substantially in the form of a waveform. The corrugations may be in the form of a square wave running from the start of the corrugated sheet to the de-congealing channel, and from the de-congealing channel to the end of the corrugated sheet. The corrugations may comprise an integer multiple of square wave periods, or any fraction of periods. The square wave waveform of the corrugations may allow for more secure manufacturing of the heat exchanger by providing flat surfaces for fixings e.g. between layers. The waveform may have a constant amplitude and/or period. The waveform may take any form that defines channels which permit a flow of fluid from one side of the sheet to the other.

The de-congealing channel may comprise a level portion of the metal sheet at a height different to the peaks and/or troughs of the corrugations. The corrugations may be formed by stamping peaks upwardly into the metal sheet and stamping troughs downwardly into the metal sheet, and hence the level portion of the de-congealing channel may be at a height between the peaks and troughs of the corrugations e.g. midway between. Alternatively, the corrugations may be formed by stamping the metal sheet in only one direction—e.g. upwardly—and the level portion of the de-congealing channel may correspondingly be at e.g. the bottom of the layer. It may be possible to consider the de-congealing channel as being formed by a corrugation with a greater width and smaller amplitude than the neighbouring corrugations.

The corrugated sheet may comprise aluminium, copper, stainless steel, nickel, Inconel, or any other suitable material. The term oil herein is used to mean to mean any fluid that may congeal or have a low viscosity when cold.

The corrugations may have a periodicity in the range of 0.01 to 0.10 inches (0.03 to 0.30 centimeters), or more preferably 0.033 to 0.083 inches (0.08 to 0.21 centimeters). The de-congealing channel may have a width approximately double the periodicity of the corrugations, and may be in the range of 0.02 to 0.2 inches (0.05 to 0.5 centimeters), or more preferably 0.066 to 0.167 inches (0.17 cm to 0.42 centimeters).

According to a second aspect of the present invention there is provided a method of manufacturing a heat exchanger, the method comprising: forming a layer of the heat exchanger by stamping a series of regular corrugations with a predetermined period into a metal sheet, and skipping a corrugation stamping step so as to create a space between two adjacent corrugations which are thus separated by greater than the predetermined period, and thereby create at least a part of a de-congealing channel.

Each stamping step may form a single corrugation, and by skipping a single stamping step while the metal sheet is moved, a space of at least one corrugation may be formed. The method may comprise missing a plurality of stamping steps (i.e. a length of sheet equivalent to a plurality of periods) so that a wider de-congealing channel is formed. The method may comprise missing a plurality of stamping steps so that a plurality of de-congealing channels are formed in each layer, separated by corrugations.

The method may comprise stamping a sheet to form a corrugated sheet as described in relation to the first aspect. The method may comprise forming a heat exchanger as described above in relation to the first aspect.

The step of forming a layer of the heat exchanger by stamping the metal sheet may comprise stamping the sheet in a first upward direction and in a second downward direction so as to form peaks and troughs of the corrugations. The up/down direction may be defined as perpendicular to the plane of the sheet. Hence a base or level portion of the de-congealing channel (which is formed of a portion of the metal sheet which has not been stamped) may be disposed at a height between the peaks and troughs of the corrugations. If the peaks of the corrugations are stamped so as to be the same height as the depth of the troughs of the corrugations, then the base of the de-congealing channel will be disposed at half the height of the sheet. The level portion of the de-congealing channel may be disposed at any suitable height between the peaks and troughs of the corrugations.

The stamping step may comprise forming an opening in the corrugation, such as an opening described above in relation to the first aspect. The opening may be formed by the stamping step, or may be formed by an additional step.

The method may comprise repeating the step of forming a layer so as to form a first plurality of layers for a flow of oil therethrough, providing a second plurality of layers for a flow of fluid therethrough, and forming the heat exchanger by alternating layers of the first and second pluralities of layers so that in use oil in the first plurality of layers is in a heat exchanging relationship with fluid in the second plurality of layers.

Forming the heat exchanger may comprise providing intervening separators between the layers of the first plurality of layers. Forming the heat exchanger may thus comprise fluidly separating the layers so that fluid cannot pass directly between layers.

BRIEF DESCRIPTION OF THE DRAWINGS

A preferred embodiment of the invention is described below by way of example only and with reference to the accompanying drawings in which.

DETAILED DESCRIPTION

Figure 1:
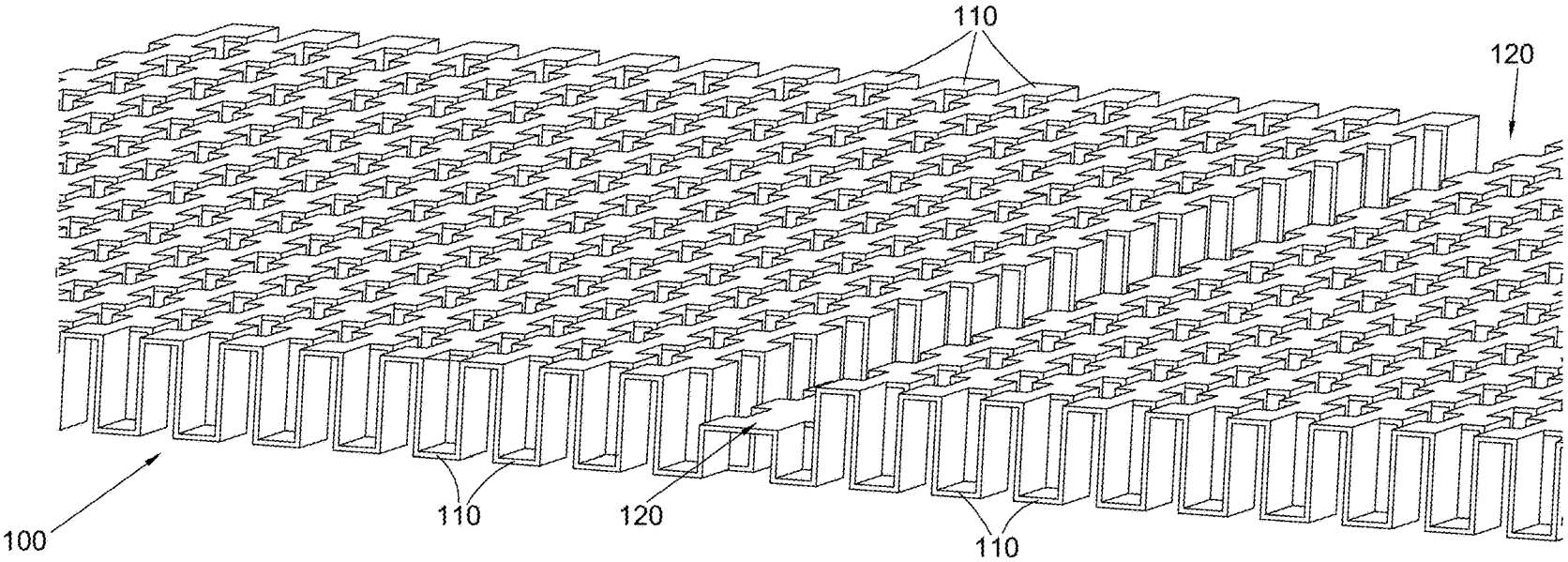
FIG. 1 shows a perspective view of a layer of a heat exchanger, the layer comprising a plurality of corrugations and de-congealing channel.

FIG. 1 shows a layer 100 of a heat exchanger comprising corrugations 110 and a de-congealing channel 120. The corrugations 110 each extend across the width 170 of the layer 100 and comprise a discontinuous oscillating shape across their length. The length of each corrugation is thus the same as the width 170 of the layer 100. The de-congealing channel 120 is defined between two corrugations 110 and also extends across the width 170 of the layer 100.

Figure 2:
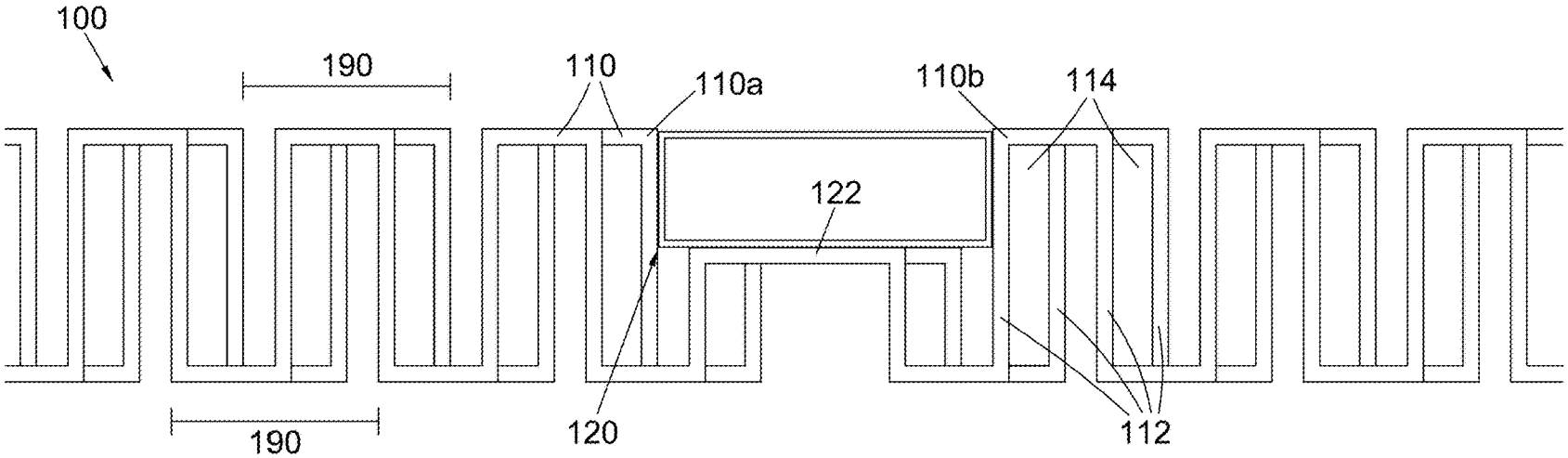
FIG. 2 shows a profile view of a portion of the layer of FIG. 1.

FIG. 2 shows the layer 100, corrugations 110, and de-congealing channel 120 in more detail. Each corrugation comprises fins 112 forming side walls of the corrugations. Each corrugation also comprises openings 114 between left and right oscillation portions of the corrugation 110, so that the fins 112 are formed from the side walls of the corrugations 110 by the openings 114. The shape of the side walls of the corrugations 110 are therefore discontinuous, and during use oil may flow through the corrugations 110 and around the fins 112 though openings 114. Oil may therefore also flow between corrugations 110.

The de-congealing channel 120 provides a larger throughway indicated by the boxed outline in FIG. 2. This throughway provides a less obstructed passage for oil flow than do the corrugations 110 with their fins 112. It is therefore easier for congealed or viscous oil to flow through the de-congealing channel 120. The de-congealing channel 120 provides a low-resistance flow path for warm oil to spread heat across to the width 170 of the layer 100.

The corrugations 110 have the form of a square-wave and have a predetermined period 190 in the length direction of the layer 100 after which they repeat. It can be seen from FIG. 2 that the corrugations 110*a* and 110*b* immediately to either side of the de-congealing channel 120 are separated by a distance greater than the predetermined period 190. Troughs of each of the corrugations 110*a* and 110*b* are adjacent the de-congealing channel 120 on either side thereof.

The layer 100 shown in FIG. 2 is formed by stamping an aluminium sheet both in an upward direction and a downward direction (in the frame of reference of FIG. 2) to form the corrugations 110. Therefore, the de-congealing channel 120 shown has a middle portion 122 which is located approximately half-way up the layer 100. It will be appreciate that this middle portion may instead be located at a different height in the de-congealing channel 120 as necessary, and may be determined by the manufacturing process of the layer. For example, the middle portion 122 may be located at the bottom on the layer, and may thus provide a larger throughway.

Figure 3:
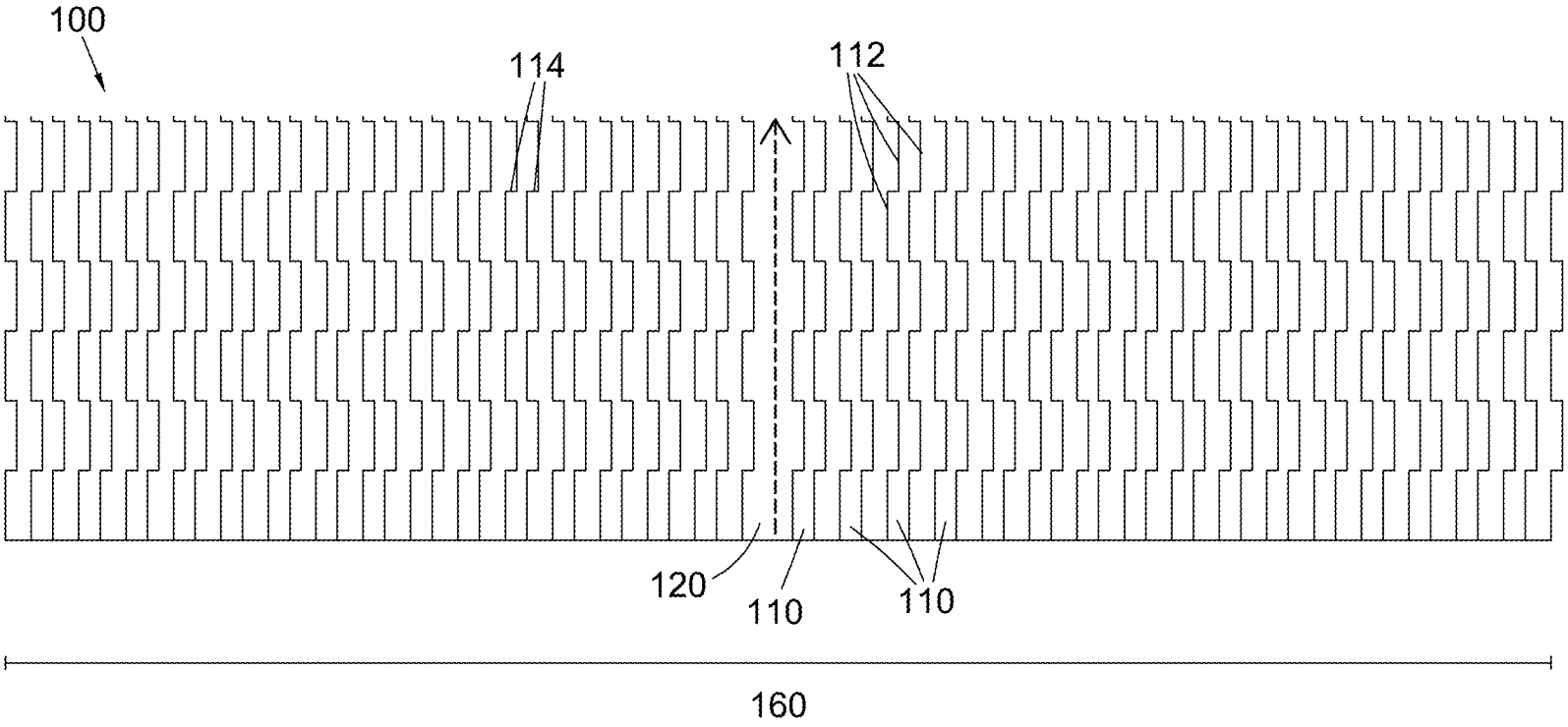
FIG. 3 shows plan view of a portion of the layer of FIG. 1.

FIG. 3 shows how the corrugations 110 oscillate along their length across the width 170 of the layer 100. The lines indicate the edges of the corrugations. It can be seen that some portions of each corrugation 110 are more to the left within the layer 100, and some portions are more to the right within the layer 100. Thus, an oscillating waveform is produced along the length of the corrugation, with the waveform being a square wave in this example. Together with the openings 114 (not shown, but formed in the horizontal line sections of FIG. 3), this geometry provides the fins 112 for interrupting and intercepting the flow of oil across the width 170 of the layer 100 and increasing heat transfer to/from the oil.

If can also be seen from FIG. 3 that the de-congealing channel 120 provides an unobstructed flow path across the layer 100 (shown by the dotted arrow). Thus, oil can flow across the layer 100 through the de-congealing channel 120 more easily than it can flow through the corrugations. More viscous or congealed oil can therefore flow more easily through the de-congealing channel. Hence the de-congealing channel can more efficiently transport warm oil, and therefore heat, across the layer 100 to de-congeal oil throughout the rest of the layer.

A heat exchanger may be formed by stacking the layer 100 with other similar layers, together with layers 200 for another fluid interspersed with the oil-carrying layers. The de-congealing channel 120 in each layer 100 may be aligned so that they are arranged one above the other, or may be arranged at any position along the length 160 of the layer 100 as required, which position may be different for each layer 100.

Figure 4:
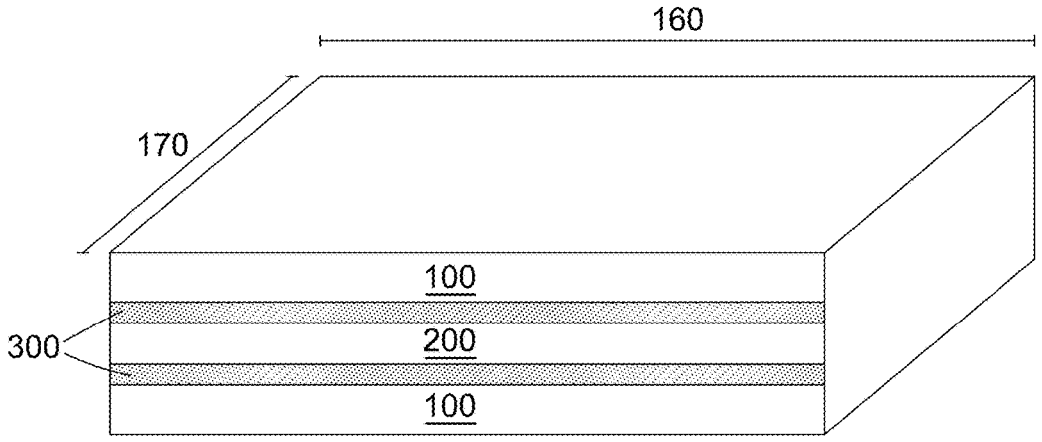
FIG. 4 shows a schematic of a heat exchanger comprising layers.

FIG. 4 shows a schematic of a heat exchanger comprising stacked layers. The oil-carrying layers 100 are disposed either side of layer 200 for another fluid, so that the oil in layers 100 is in heat exchange relationship with the fluid in layer 200. Separators 300 are disposed between the layers 100 and 200. Details of the corrugations 110 and de-congealing channels 120 of layer 100 are not shown in FIG. 4.

The proposed heat exchanger provides increased flexibility of heat exchanger manufacture since a de-congealing channel may be simply provided at any position within each layer. This also avoids the need to manufacture a specialist, dedicated de-congealing layer so provides a simpler manufacturing option. It also reduces the risk of mistakes during manufacture, since the layers may not need to be assembled in a particular order. The de-congealing channel can be used in any heat exchanger configuration/type, and unlike a dedicated de-congealing layer, is not limited to use in multi-pass heat exchangers. The proposed arrangement also offers greater flexibility when it comes to the number of de-congealing channels which can be employed in each unit. The number, and spacing between layers, can be bespoke to fit the demands of each application.

The invention claimed is:

1. A heat exchanger comprising:

a first plurality of layers, each of the first plurality of layers including:

a corrugated sheet comprising a series of regular corrugations across its width for flow of liquid therethrough, the series of corrugations having a predetermined period; and a de-congealing channel for flow of liquid across the width of the corrugated sheet in parallel with the corrugations, the de-congealing channel formed at least in part by two adjacent corrugations that are separated by greater than the predetermined period.

2. A heat exchanger as claimed in claim 1, wherein each corrugation has an oscillating geometry along the length of the corrugation across the width of the corrugated sheet.

3. A heat exchanger as claimed in claim 1, wherein each corrugation comprises an opening for fluid communication between the corrugations.

4. A heat exchanger as claimed in claim 1, comprising a plurality of fins for intercepting or directing a flow of liquid through the corrugation.

5. A heat exchanger as claimed claim 1, wherein the de-congealing channel forms a throughway from one side to an other side of each layer of the first plurality of layers that is larger than throughways formed by the corrugations.

6. A heat exchanger as claimed in claim 1, further comprising a second plurality of layers for flow of a fluid therethrough, the heat exchanger comprising alternating layers from the first and second pluralities of layers.

7. A heat exchanger as claimed in claim 1, wherein the layers of the second plurality of layers prevent flow of liquid between the layers of the first plurality of layers.

8. A heat exchanger as claimed in claim 1, comprising a separator between layers of the heat exchanger for preventing fluid flow between those layers.

9. A heat exchanger as claimed in claim 1, wherein the de-congealing channel of each layer of the first plurality of layers is aligned with the de-congealing channel of one of the nearest other layers of the first plurality of layers.

10. A heat exchanger as claimed in claim 1, wherein the de-congealing channel of each layer of the first plurality of layers is not aligned with the de-congealing channel of one of the nearest other layers of the first plurality of layers.

11. A heat exchanger as claimed in claim 1, wherein the series of corrugations is in the form of a waveform.

* * * * *